US007082770B2

(12) United States Patent
Martling et al.

(10) Patent No.: US 7,082,770 B2
(45) Date of Patent: Aug. 1, 2006

(54) FLOW SLEEVE FOR A LOW NOX COMBUSTOR

(76) Inventors: Vincent C. Martling, 10296 Sandy Run Rd., Jupiter, FL (US) 33478; Martin John Spalding, 6305 Lucerne St., Jupiter, FL (US) 33458; Madhavan Poyyapakkam, 322 Pennell Cir., Apt. 4, Tallahassee, FL (US) 32310

( * ) Notice: Subject to any disclaimer, the term of this patent is extended or adjusted under 35 U.S.C. 154(b) by 29 days.

(21) Appl. No.: 10/746,310

(22) Filed: Dec. 24, 2003

(65) Prior Publication Data

US 2005/0144953 A1 Jul. 7, 2005

(51) Int. Cl.
*F23R 3/42* (2006.01)

(52) U.S. Cl. ..... 60/796; 60/752

(58) Field of Classification Search ..... 60/722, 60/746, 752, 760, 796, 800, 252
See application file for complete search history.

(56) References Cited

U.S. PATENT DOCUMENTS

| | | | | |
|---|---|---|---|---|
| 4,872,312 | A | 10/1989 | Iizuka et al. | |
| 5,291,732 | A * | 3/1994 | Halila | 60/796 |
| 5,802,854 | A | 9/1998 | Maeda et al. | |
| 6,334,310 | B1 | 1/2002 | Sutcu et al. | |
| 2004/0261419 | A1 * | 12/2004 | McCaffrey et al. | 60/796 |

* cited by examiner

*Primary Examiner*—Louis J. Casaregola

(57) ABSTRACT

A gas turbine combustor structure having improved cooling effectiveness and increased life as well as a method for improving the cooling effectiveness is disclosed. The gas turbine combustor incorporates a unique flow sleeve configuration for directing air to more effectively cool a combustion liner. The flow sleeve geometry is configured to incorporate a conical aft portion having a plurality of air feed holes that reduce pressure loss to the incoming air and flow separation effects from the surrounding combustor hardware, thereby resulting in improved combustor performance.

8 Claims, 5 Drawing Sheets

FLOW SLEEVE FOR A LOW NOX COMBUSTOR

BACKGROUND OF THE INVENTION

1. Field of the Invention

The present invention relates to gas turbine combustors and more specifically to a flow sleeve having an inlet region that reduces pressure loss to the compressed air entering a combustor.

2. Description of Related Art

A gas turbine engine typically comprises a multi-stage compressor, which compresses air drawn into the engine to a higher pressure and temperature. A majority of this air passes to the combustors, which mixes the compressed heated air with fuel and contains the resulting reaction that generates the hot combustion gases. These gases then pass through a multi-stage turbine, which drives the compressor, before exiting the engine. In land-based gas turbines, the turbine is also coupled to a generator for generating electricity.

For land-based gas turbine engines, often times a plurality of combustors are utilized. Each of the combustion systems include a case that serves as a pressure vessel containing the combustion liner, which is where the high pressure air and gas mix and react to form the hot combustion gases. Typically the case is fabricated from a lower temperature capable material such as carbon-steel. In order to ensure that the case is not overexposed to the temperatures of the combustion liner as well to ensure that the combustion liner receives the proper amount of air for cooling and mixing with the fuel, an additional liner is often located within the case and is coaxial to the combustion liner and case. This additional liner is more commonly referred to as a flow sleeve.

A two-stage combustion system of the prior art commonly used in land-based gas turbine engines is shown in cross section in FIG. 1. Combustor 10 includes a generally annular case 11 having a center axis A—A and an end cover 12 that is fixed to a case flange and contains a plurality of fuel nozzles 13 located about center axis A—A. Located coaxial to center axis A—A is a combustion liner 14 having a first combustion chamber 15 and second combustion chamber 16, separated by venturi 17 having a throat of reduced cross sectional area 18. An additional fuel nozzle 19 is located along center axis A—A. Located coaxial to combustion liner 14 and radially between case 11 and combustion liner 14 is flow sleeve 20. As mentioned previously, flow sleeve 20 serves to direct compressed air along the outer walls of liner 14 for cooling purposes, as well as for being injected to mix with the fuel for combustion. In combustor 10 of the prior art, flow sleeve 20 forms a generally annular passageway 21 around combustion liner 14 for directing the required amount of compressed air to combustion liner 14 for cooling and mixing with the fuel from fuel nozzles 13 and 19. In prior art combustor 10, compressed air is introduced to the combustion system through a generally annular flow sleeve inlet 22, which is shown in a more detailed cross section in FIG. 2.

Flow sleeve inlet 22 is formed between flow sleeve 20 and transition duct 25, which has a bellmouth portion 26 and a structural support ring 27, each of which are located towards the forward end of transition duct 25. In this combustor configuration, bellmouth 26 and support ring 27 create obstructions that block or disturb a portion of the compressed air flow that enters passageway 21 through flow sleeve inlet 22, thereby causing an undesirable pressure loss to the air supply. This disturbance to the air flow and resulting pressure loss has multiple negative effects on the hardware durability and performance. Specifically, hula seal 28, which, in the prior art, is a seal encompassing the aft end outer surface of liner 14 and contains a plurality of axial slots that form "fingers" that spring to seal between liner 14 and transition duct 25, does not receive sufficient cooling air due to a separation zone 29 created by air flow passing over bellmouth 26 (see FIG. 2). As a result of this lack of cooling air, the aft end of combustion liner 14 and hula seal 28 operate at a higher temperature, causing more radial interference between hula seal 28 and transition duct 25 than desired, leading to premature wear of hula seal 28. The flow disturbances created by bellmouth 26 and ring 27 combined with the geometry of flow sleeve inlet 22, due to the axial length of the aft region of flow sleeve 20, creates a pressure loss to the incoming air supply. The pressure loss at flow sleeve inlet 22, which is approximately 1.5% of the available air pressure, results in a lower cooling air supply pressure to combustion liner 14. Annular passageway 21 creates little, if any, additional pressure loss to the cooling air. As a result, less air is passed through the various passages requiring cooling and injected for mixing with the fuel, thereby resulting in higher operating temperatures, a less durable design, and reduced combustor performance. As one skilled in the art of gas turbine combustion will understand, maintaining adequate cooling of the combustion liner is imperative for combustor durability and performance.

Therefore, what is needed is a flow sleeve for a gas turbine combustor having an inlet region that reduces the pressure loss to the incoming compressed air, such that a high enough air pressure is available to provide sufficient cooling to the combustion liner surfaces. This is especially true for combustors that operate for an extended period of time and require large amounts of cooling and enhanced mixing in order to achieve low emissions.

SUMMARY AND OBJECTS OF THE INVENTION

A gas turbine combustor structure having improved cooling effectiveness and increased life as well as a method for improving the cooling effectiveness is disclosed. The gas turbine combustor in accordance with the preferred embodiment of the present invention comprises a generally cylindrical case that serves as a pressure vessel having a generally cylindrical end cover fixed to a first case flange. The end cover has a plurality of first fuel nozzles arranged about a center axis. Located within the case and coaxial to the center axis is a flow sleeve that is used to direct compressed air along a combustion liner for cooling and injection into the liner. The flow sleeve has a first portion that is generally cylindrical in shape, a mounting flange for mounting the flow sleeve to a second case flange, and a second portion that is generally conical in shape that is fixed to the first portion of the flow sleeve. The second portion of the flow sleeve contains a plurality of feed holes for supplying cooling air to a generally annular passageway that is formed between the flow sleeve and the combustion liner. The combustion liner is in fluid communication with a plurality of fuel nozzles and is supplied with air from the generally annular passageway for cooling of the liner walls as well as for mixing with fuel that is injected from the fuel nozzles. Hot combustion gases formed in the combustion liner are directed towards the turbine section by way of a transition duct. In order to prevent hot gases from leaking, the combustion liner seals to the transition duct by a seal located proximate the liner aft end outer wall that has a means for passing cooling air through the seal to cool beneath the seal.

The present invention avoids the shortcomings of the prior art by providing an improved flow sleeve design that reduces the pressure loss to the cooling air at the flow sleeve inlet, by approximately 50%, thereby providing the combustion liner with higher pressure air for cooling and mixing with fuel for combustion. This is accomplished by altering the flow sleeve inlet region such that all air enters the flow sleeve upstream of the transition duct and a majority of that air enters the flow sleeve through a plurality of feed holes in the conical portion of the flow sleeve. Moving the air inlet location away from the transition piece bellmouth and support ring as well as reconfiguring the inlet geometry, eliminates a majority of the pressure losses associated with the prior art configuration.

It is an object of the present invention is to provide a gas turbine combustor having lower pressure losses to the cooling air supply pressure.

It is another object of the present invention to provide a method of improving the cooling effectiveness of an aft region of a combustion liner.

It is yet another object of the present invention to provide a gas turbine combustor having improved durability as a result of the lower pressure losses to the cooling air supply.

In accordance with these and other objects, which will become apparent hereinafter, the instant invention will now be described with particular reference to the accompanying drawings.

DETAILED DESCRIPTION OF THE PREFERRED EMBODIMENT

Figure 1:
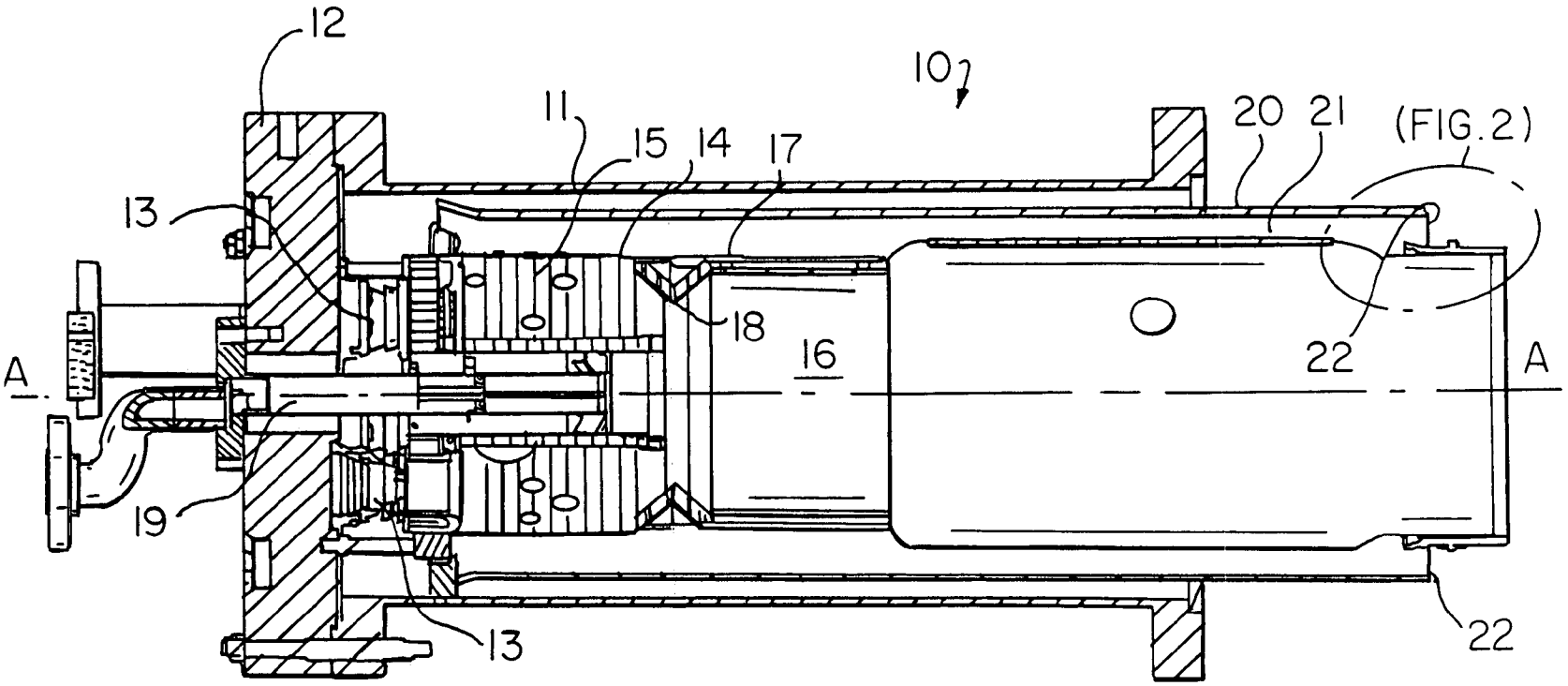
FIG. 1 PRIOR ART
FIG. 1 is a cross section view of a gas turbine combustor of the prior art.
Figure 2:
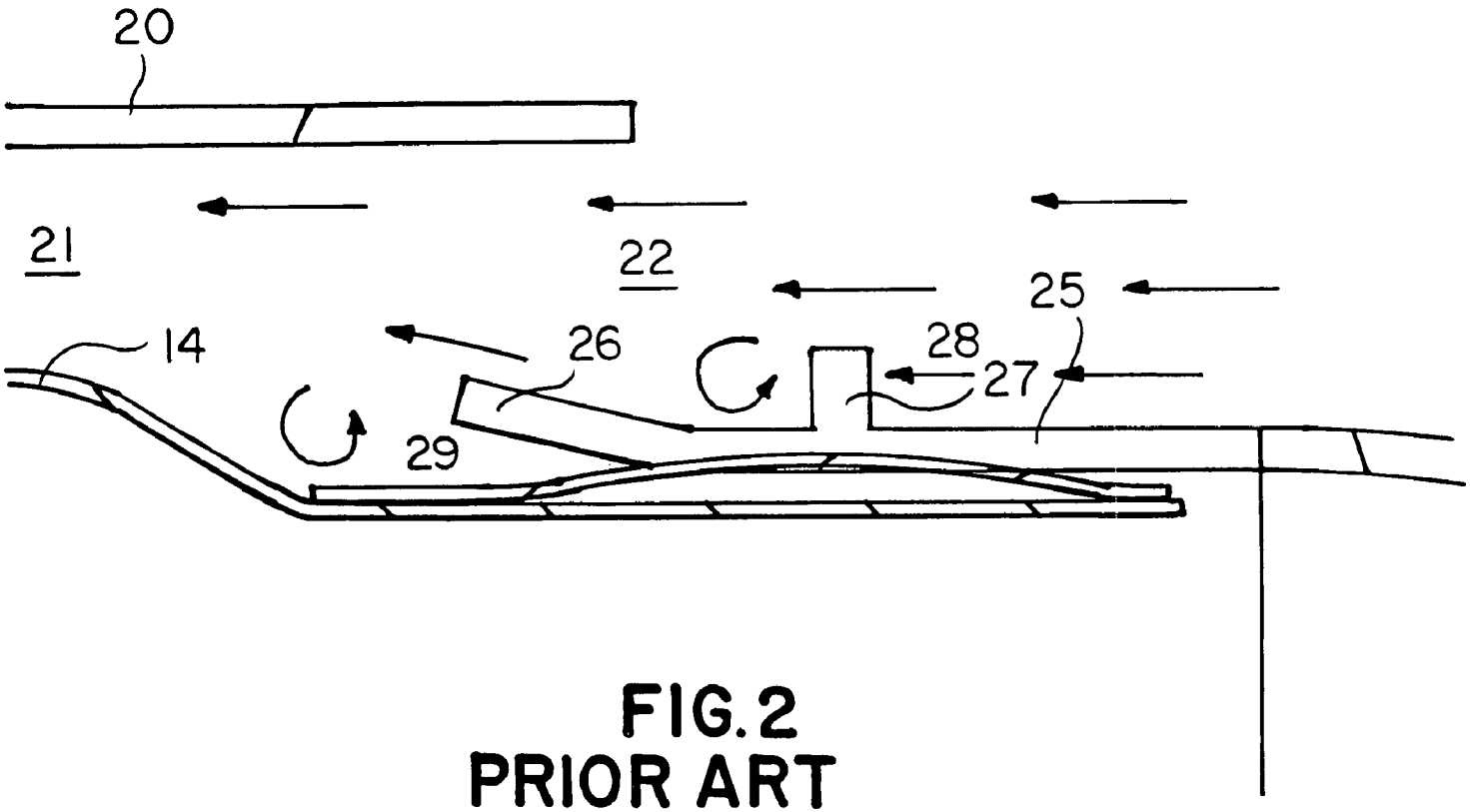
FIG.2 PRIOR ART
FIG. 2 is a detailed cross section view of the flow sleeve inlet region of a gas turbine combustor of the prior art.
Figure 3:
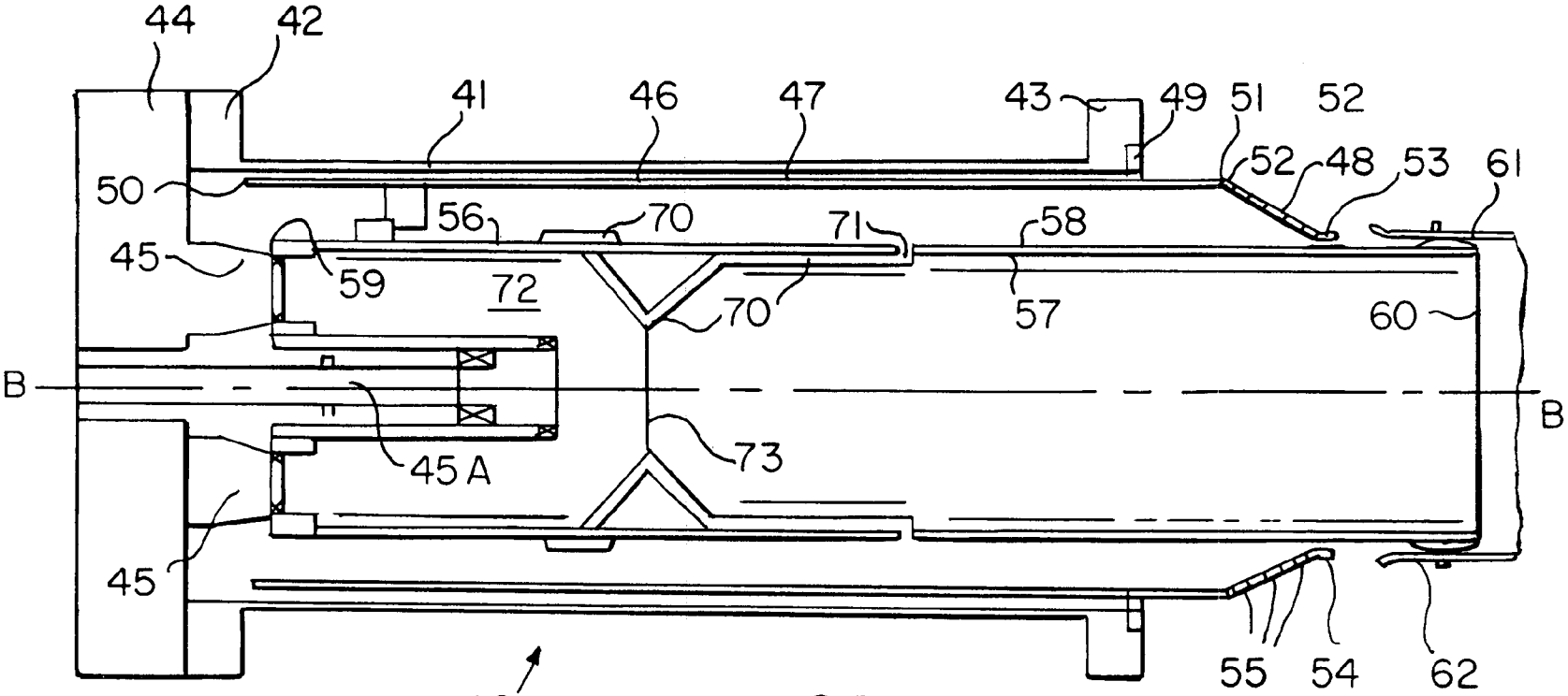
FIG. 3 is a cross section view of a gas turbine combustor in accordance with the preferred embodiment of the present invention.

The preferred embodiment of the present invention is shown in detail in FIGS. 3–5B. Gas turbine combustor 40, in accordance with the present invention comprises a generally cylindrical case 41 having center axis B—B, first case flange 42, and second case flange 43. Fixed to first case flange 42 is a generally cylindrical end cover 44 that has a plurality of first fuel nozzles 45 arranged in an annular array about center axis B—B. Located radially within case 41 and coaxial to center axis B—B is flow sleeve 46 having first portion 47, second portion 48, and mounting flange 49. First portion 47 is generally cylindrical in shape and has a first end 50 located proximate first case flange 42. Mounting flange 49 extends radially outward from first portion 47 and is located axially along first portion 47 proximate second case flange 43, and fixes flow sleeve 46 to case 41 at second case flange 43. For the preferred embodiment, second end 51 of first portion 47 is located proximate mounting flange 49. Flow sleeve 46 also includes second portion 48, which is generally conical in shape, and has a first end 52, which is fixed to second end 51 of first portion 47, and a second end 53 having an inlet ring 54. Located around the perimeter of second portion 48 is a plurality of feed holes 55. The location and size of the feed holes can vary depending on the required air flow, but for the preferred embodiment, the feed holes are arranged in at least one row about second portion 48 of flow sleeve 46.

Figure 4:
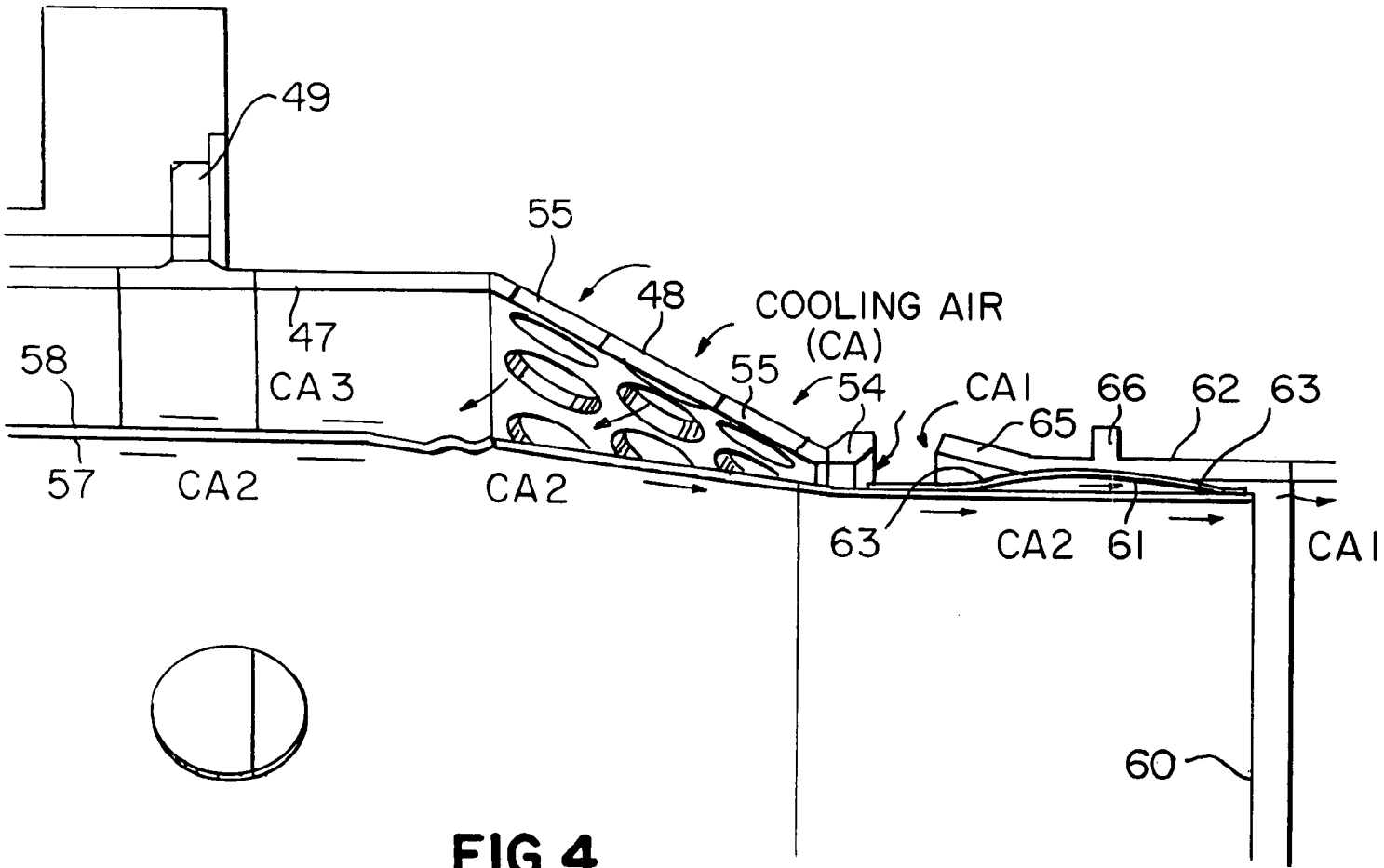
FIG. 4 is a detailed cross section view of the flow sleeve inlet region of a gas turbine combustor in accordance with the preferred embodiment of the present invention.
Figure 5A:
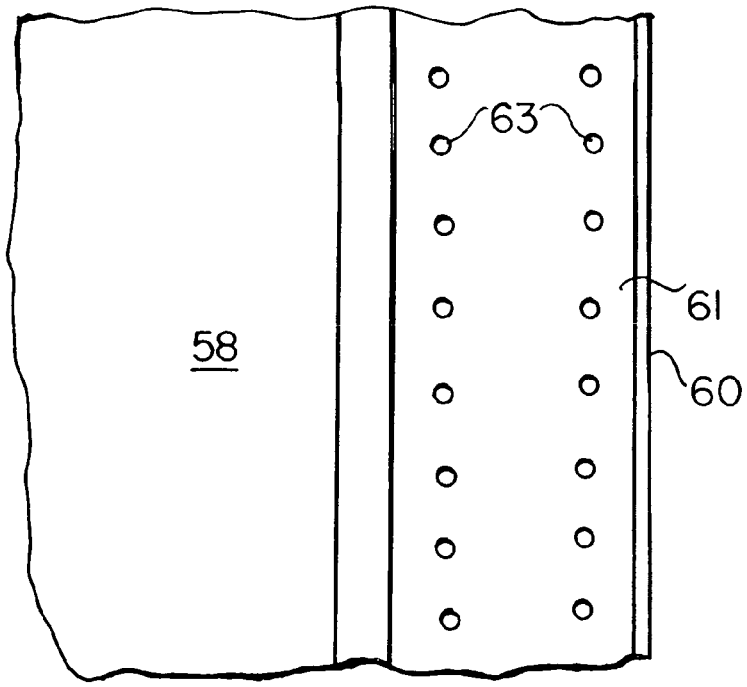
FIGS. 5A and 5B are elevation views of a portion of the aft section of a combustion liner and seal, including a means for passing cooling air through the seal, in accordance with the preferred embodiment of the present invention.
Figure 5B:
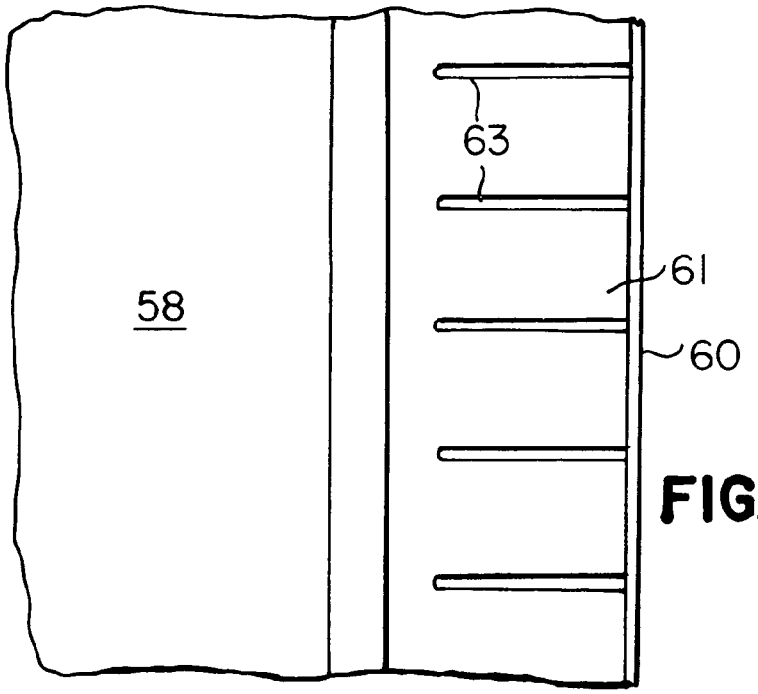

Located within flow sleeve 46 and coaxial to center axis B—B is a generally annular combustion liner 56 that is in fluid communication with first fuel nozzles 45 and a second fuel nozzle 45A. Combustion liner 56 comprises an inner wall 57, an outer wall 58, a first liner end 59, and a second liner end 60, with a seal 61 fixed to and encompassing outer wall 58 proximate second liner end 60. Seal 61, which seals against transition duct 62, also includes a means for passing cooling air through seal 61. The sealing interface region and aft end of combustion liner 56 is shown in greater detail in FIG. 4. Further details regarding the means disclosed for passing cooling air through seal 61 is shown in FIGS. 5A and 5B. Specifically, two configurations are shown that each comprise a plurality of openings 63 that pass a first supply of cooling air through seal 61 to cool outer wall 58 of combustion liner 56 proximate second liner end 60. In order to provide surface cooling to inner wall 57 proximate second liner end 60, a second supply of cooling air is directed along inner wall 57 for cooling the aft end region of combustion liner 56. The second supply of cooling air can be directed along inner wall 57 by a variety of means, most commonly through a plurality of precisely sized cooling holes located in combustion liner 56 proximate the region requiring cooling.

The cooling air (CA) entering the flow sleeve inlet region is used for three purposes proximate the aft end of combustor 40. Each of these locations benefit from the flow sleeve redesign to reduce the pressure loss to the cooling air. Referring now specifically to FIG. 4, aft end of combustor 40 is shown in detail and includes a plurality of arrows indicating the cooling air (CA) and its various directions. A first supply of cooling air, CA1, is directed between bellmouth 65 of transition duct 62 and inlet ring 54 of flow sleeve 46. First supply of cooling air CA1 is directed through plurality of openings 63 in seal 61 to cool outer wall 58 of combustion liner 56 in the region beneath seal 61 and area proximate second liner end 60. The quantity and configuration of openings 63 in seal 61 depends on the amount of air required in order to achieve sufficient cooling. As shown in FIG. 5, openings 63 can take on different configurations, such as holes or slots.

A second supply of cooling air CA2 is primarily directed through feed holes 55 in second portion 48 of flow sleeve 46 and is injected into combustion liner 56 at a region requiring cooling along inner wall 57. The exact location and orientation of the injected air depends on the combustion liner operating conditions and amount of available cooling air. The location of feed holes 55 ensures a sufficient supply of cooling air with minimal pressure loss since feed holes 55 are placed upstream of transition duct bellmouth 65 and support ring 66, such that any flow disturbance from the bellmouth or support ring are insignificant.

A third supply of cooling air CA3 is directed through feed holes 55 in second portion 48 of flow sleeve 46 and along outer wall 58 and towards first liner end 59 for cooling combustion liner 56 and for mixing with fuel from fuel nozzles 45 inside combustion liner 56. Feed holes 55 are sized such that the pressure drop across the feed holes is minimized, thereby supplying a higher air pressure to the cooling and combustion process than the prior art gas turbine combustor. This is especially imperative when cooling a dual stage combustor that incorporates an effusion cooled combustion liner and a counter flow venturi, similar to that shown in FIG. 3, and disclosed in U.S. Pat. Nos. 6,427,446, 6,446,438, and 6,484,509, assigned to the same assignee herein. In this type of combustion system, cooling air is drawn in to venturi cooling passageway 70 proximate venturi aft end 71 and is injected into a chamber 72 upstream of the venturi throat 73 for mixing with the fuel and air, such that the fuel/air mixture is leaner, resulting in lower emissions. When cooling a venturi in this manner, the temperature of the cooling air rises dramatically while the air pressure drops as it passes through venturi cooling passageway 70, prior to being injected into chamber 72. Flow throughout venturi cooling passageway 70 relies on pressure changes to pass the cooling air from venturi aft end 71 to chamber 72. Therefore, given the known pressure losses to occur in this system, the air entering venturi cooling passageway 70 must initially have a higher pressure in order to adequately cool the venturi system and be injected into chamber 72 for mixing with fuel for combustion. This higher air pressure is possible due to the redesigned second portion geometry that moves the air inlet region forward of the transition duct bellmouth 65 and support ring 66, such that the inlet region is removed from any disturbances created by either of these structures while also introducing a majority of the air through a plurality of feed holes 55.

Inherent in the aforementioned gas turbine combustor structure is a method of improving the cooling effectiveness and increasing component life of a combustion liner aft region. The method comprises the steps of providing a gas turbine combustor 40 having a case 41 with first case flange 42 and second case flange 43, a transition duct 62, a flow sleeve 46 with a first portion 47 generally cylindrical in shape, having a first end 50, a second end 51, and a mounting flange 49 for securing flow sleeve 46 to second case flange 43, and a second portion 48 generally conical in shape having a first end 52, a second end 53, and a plurality of feed holes 55. First end 52 of said second portion 48 is fixed to second end 51 of said first portion 47 and second end 53 of second portion 48 has an inlet ring 54. Gas turbine combustor 40 also has a combustion liner 56, that is located radially within flow sleeve 46, and has an inner wall 57, an outer wall 58, a first liner end 59, a second liner end 60, and a seal 61, having a means for passing cooling air through seal 61, fixed to outer wall 58 proximate second liner end 60. Preferably, means for passing cooling air through seal 61 comprises a plurality of openings 63, which can be a variety of configurations, including holes or slots.

Next, a first supply of cooling air, CA1, passes through an opening between flow sleeve support ring 54 transition duct 62 and is directed through plurality of openings 63 in seal 61 to cool outside wall 58 of combustion liner 56 and the region beneath seal 61. Also, a second supply of cooling air, CA2, which passes primarily through plurality of feed holes 55, is injected into combustion liner 56 and directed along inner wall 57 for cooling purposes. Typically cooling air CA2 enters combustion liner 56 through a plurality of cooling holes whose location depends on the combustor configuration. Finally, a third supply of cooling air, CA3, which also passes through plurality of feed holes 55, is directed along outer wall 58 of combustion liner 56 for additional liner aft end cooling as it flows towards venturi cooling passageway 70 and first liner end 59. Each of the cooling air supplies CA1, CA2, and CA3 are supplied to combustor 40 at a higher pressure than in prior art combustors due to the redesigned flow sleeve second portion 48, including feed holes 55, and its location relative to transition duct 62.

While the invention has been described in what is known as presently the preferred embodiment, it is to be understood that the invention is not to be limited to the disclosed embodiment but, on the contrary, is intended to cover various modifications and equivalent arrangements within the scope of the following claims.

We claim:

1. A gas turbine combustor having improved cooling effectiveness and increased life, said gas turbine combustor comprising:

a generally cylindrical case having a center axis, a first case flange, and a second case flange;

a generally cylindrical end cover fixed to said first case flange, said end cover having a plurality of first fuel nozzles arranged in an annular array about said center axis;

a flow sleeve located radially within said case and coaxial with said center axis, said flow sleeve comprising:

a first portion generally cylindrical in shape, having a first end, a second end, and a mounting flange, said first end proximate said first case flange, said mounting flange extending radially outward and located proximate said second case flange, and said second end proximate said mounting flange;

a second portion generally conical in shape having a first end, a second end, and a plurality of feed holes, said first end of said second portion fixed to said second end of said first portion and said second end of said second portion having an inlet ring;

wherein said mounting flange fixes said flow sleeve to said case at said second case flange;

a combustion liner located radially within said flow sleeve, coaxial with said center axis, and in fluid communication with said plurality of first fuel nozzles, said combustion liner comprising:

an inner wall, an outer wall, a first liner end, a second liner end, and a plurality of receptacles for receiving said plurality of first fuel nozzles; and, a seal fixed to said outer wall proximate said second liner end, said seal having a means for passing cooling air through said seal.

2. The gas turbine combustor of claim 1 wherein said means for passing cooling air comprises a plurality of openings.

3. The gas turbine combustor of claim 2 wherein a first supply of cooling air is directed through said plurality of openings in said seal to cool said outer wall of said liner proximate said second end.

4. The gas turbine combustor of claim 3 wherein a second supply of cooling air is directed along said inner wall of said liner to cool said inner wall proximate said second end.

5. The gas turbine combustor of claim 1 wherein said plurality of feed holes are arranged in at least one row about said second portion of said flow sleeve.

6. The gas turbine combustor of claim 1 wherein said feed holes are located forward of said combustion liner seal.

7. The gas turbine combustor of claim 1 wherein said seal is in contact with a transition duct.

8. The gas turbine combustor of claim 4 wherein a third supply of cooling air is directed along said outer wall of said liner towards said first liner end.

* * * * *